US010186210B2

(12) United States Patent
Umeyama et al.

(10) Patent No.: US 10,186,210 B2
(45) Date of Patent: Jan. 22, 2019

(54) IMAGE DISPLAY DEVICE AND CONTROL METHODS FOR IMAGE DISPLAY DEVICE

(71) Applicant: CANON KABUSHIKI KAISHA, Tokyo (JP)

(72) Inventors: Manabu Umeyama, Yokohama (JP); Miyako Takahashi, Kawasaki (JP); Takeshi Ikeda, Ebina (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/140,070

(22) Filed: Apr. 27, 2016

(65) Prior Publication Data

US 2016/0322005 A1 Nov. 3, 2016

(30) Foreign Application Priority Data

May 1, 2015 (JP) ..... 2015-094403

(51) Int. Cl.
*G09G 3/34* (2006.01)

(52) U.S. Cl.
CPC ... *G09G 3/3426* (2013.01); *G09G 2320/0646* (2013.01); *G09G 2360/16* (2013.01)

(58) Field of Classification Search
CPC ..... G09G 3/3413; G09G 3/3696; G09G 2320/0271; G09G 2320/0238; G09G 2320/0233; G09G 3/342; G09G 5/10; G09G 3/2003; G09G 3/3426; G09G 2320/0646; G09G 2360/16; G09G 3/2007
See application file for complete search history.

(56) References Cited

U.S. PATENT DOCUMENTS

2010/0295879 A1* 11/2010 Tanaka ..... G09G 3/3426 345/690
2012/0268505 A1* 10/2012 Tani ..... G09G 3/342 345/694
2013/0265337 A1* 10/2013 Furumoto ..... G09G 5/10 345/690
2014/0160181 A1* 6/2014 Takeda ..... G09G 3/2007 345/690

(Continued)

FOREIGN PATENT DOCUMENTS

WO 2011-121630 A1 10/2011

*Primary Examiner* — Richard Hong
(74) *Attorney, Agent, or Firm* — Canon U.S.A., Inc. IP Division

(57) ABSTRACT

An image display device includes light emission units, a display unit having display areas corresponding to the light emission units, a determination unit determining whether the display areas are a first area satisfying a predetermined condition or a second area having luminance lower than that of the first area, respectively, based on an input image signal, a light emission control unit controlling light emitted from the light emission units to reduce an amount of light emitted from a light emission unit corresponding to the second area relative to an amount of light emitted from a light emission unit corresponding to the first area, and a correction unit outputting a displayed image signal to the display unit, and the displayed image signal is obtained by adding a first correction value to a portion corresponding to a partial area of the second area of the image signal.

20 Claims, 12 Drawing Sheets

(56) References Cited

U.S. PATENT DOCUMENTS

2015/0302789 A1* 10/2015 Furihata ..... G09G 3/2007
345/694
2015/0356905 A1* 12/2015 Watanabe ..... G09G 3/2003
345/88

* cited by examiner

IMAGE DISPLAY DEVICE AND CONTROL METHODS FOR IMAGE DISPLAY DEVICE

BACKGROUND OF THE INVENTION

Field of the Invention

The present invention relates to an image display device, an image display system, and control methods therefor.

Description of the Related Art

Conventionally, in an image display device including a liquid crystal panel, partial disorder of liquid-crystal molecular orientation is sometimes caused by stress of a member supporting the liquid crystal panel, or the like. The disorder of the liquid-crystal molecular orientation cannot fully reduce transmissivity of light through the liquid crystal molecules, when low-gradation image data is input. Thus, transmittance in the liquid crystal panel is uneven, and when a low-gradation image is displayed, partial bright area may be generated (referred to as uneven black display in the present specification).

A technology for correction of the uneven black display is disclosed in International Publication No. 2011/121630. In the technology, a signal obtained by adding a correction value to input signal gradation is input to a liquid crystal panel to align liquid crystal molecules, for correction of the uneven black display.

SUMMARY OF THE INVENTION

An image display device according to an embodiment of the present invention includes a plurality of light emission units configured to be separately controlled in light emission, a display unit having a plurality of display areas corresponding to the plurality of light emission units, and configured to transmit light emitted from the plurality of light emission units to display an image, a determination unit configured to determine whether the plurality of display areas is a first area satisfying a predetermined condition or a second area having luminance lower than that of the first area, respectively, based on an input image signal, a light emission control unit configured to control light emitted from the plurality of light emission units to reduce an amount of light emitted from a light emission unit corresponding to the second area relative to an amount of light emitted from a light emission unit corresponding to the first area, and a correction unit configured to output a displayed image signal to the display unit, the displayed image signal being obtained by adding a first correction value to a portion corresponding to at least partial area of the second area of the image signal.

Further, a control method for an image display device performed by at least one processor according to an embodiment of the present invention includes determining whether a plurality of display areas of a display unit is a first area satisfying a predetermined condition or a second area having a luminance lower than that of the first area, based on an input image signal, outputting, to the display unit, a displayed image signal obtained by adding a first correction value to a portion corresponding to at least area portion of the second area, of the image signal, and controlling light emitted from the plurality of light emission units to reduce an amount of light emitted from a light emission unit corresponding to the second area of a plurality of light emission units configured to emit light to the display unit, relative to an amount of light emitted from a light emission unit corresponding to the first area of the plurality of light emission units.

Still further, a control method for an image display device according to an embodiment of the present invention is a control method for an image display device including a plurality of light emission units configured to be separately controlled in light emission, and a display unit having a plurality of display areas corresponding to the plurality of light emission units, and configured to transmit light emitted from the plurality of light emission unit, and display an image, the control method for an image display device which includes outputting, to the display unit, a displayed image signal obtained by adding a first correction value to a portion corresponding to at least partial area of the second area, of the image signal, determining whether a plurality of display areas is a first area satisfying a predetermined condition or a second area having a luminance lower than that of the first area, based on an input image signal, and controlling light emitted from the plurality of light emission units to reduce an amount of light emitted from a light emission unit corresponding to the second area, relative to an amount of light emitted from a light emission unit corresponding to the first area.

Further features of the present invention will become apparent from the following description of exemplary embodiments (with reference to the attached drawings).

DESCRIPTION OF THE EMBODIMENTS

First Embodiment

Figure 1:
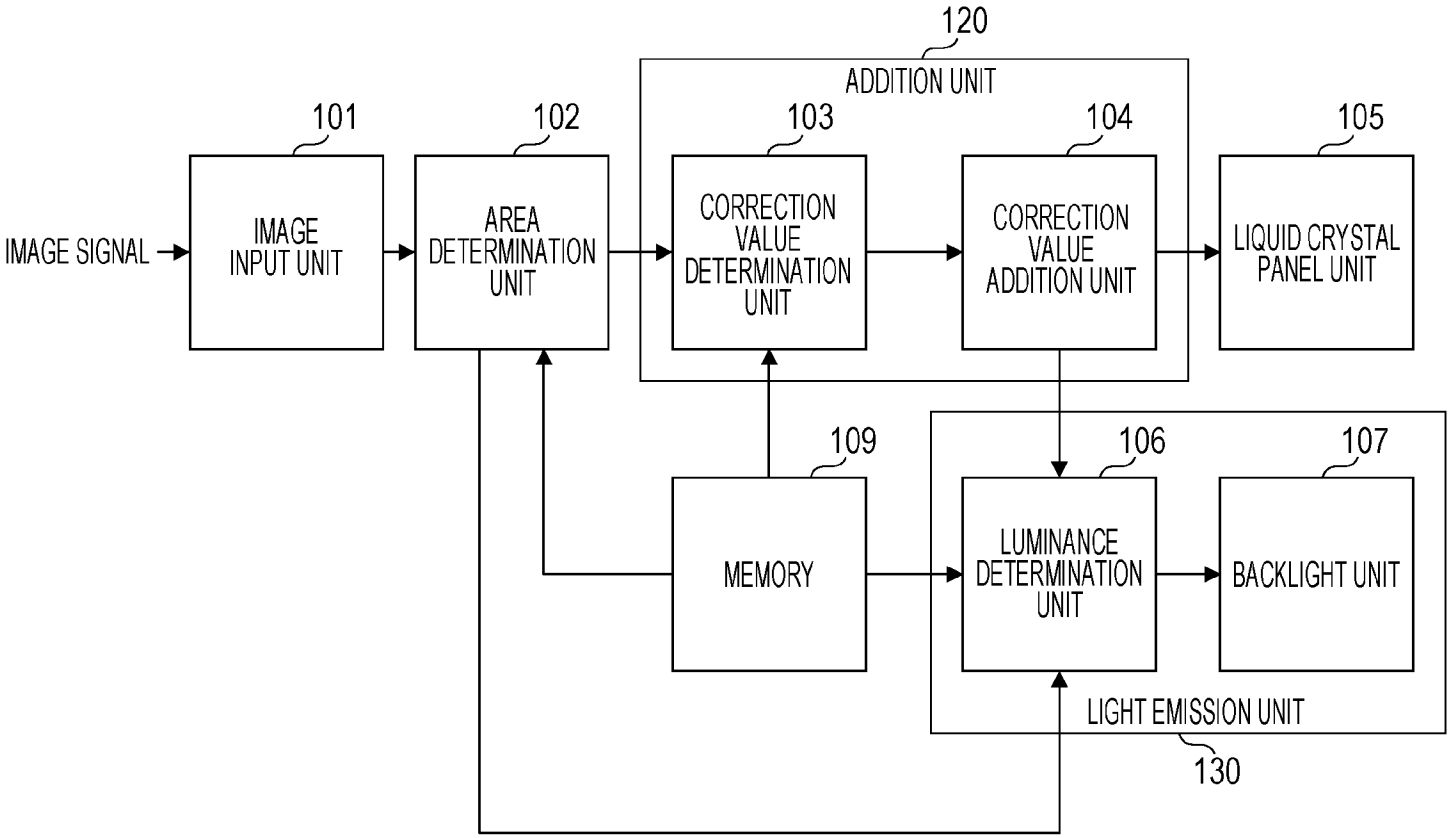
FIG. 1 is a block diagram illustrating a schematic configuration of an image display device according to a first embodiment of the present invention.

An image display device and a control method therefor according to a first embodiment of the present invention will be described. FIG. 1 is a block diagram illustrating a schematic configuration of the image display device 100 according to the first embodiment of the present invention. The image display device 100 illustrated in FIG. 1 includes an image input unit 101, an area determination unit 102, an addition unit 120, a liquid crystal panel unit 105, a light emission unit 130, and a memory 108. Furthermore, the addition unit 120 includes a correction value determination unit 103 and a correction value addition unit 104. The light emission unit 130 includes a luminance determination unit 106 and a backlight unit 107. The image display device 100 includes functional blocks controlled by a central processing unit (CPU) not illustrated.

Note that in the present embodiment, the image display device 100 includes, as an embodiment of a display unit, a display device including a transmissive liquid crystal panel, but the display panel is not limited to the liquid crystal panel. The display panel is preferably a transmissive display panel. Instead of a liquid crystal element, a display element for transmitting light from backlight is preferably used, and for example, a transmissive display panel using a micro electro mechanical system (MEMS) shutter element may be used.

An image is input to the image input unit 101 from an external device. In the present embodiment, an X-ray image is input from an external device wiredly connected. Note that, image data may be acquired via a digital visual interface (DVI) or the like, or a file acquired via a local area network (LAN) or the like may be decoded.

The area determination unit 102 determines whether the image input to the image input unit 101 is an object area or a background area having a luminance lower than that of the object area. Specifically, the area determination unit 102 divides the image obtained from the image input unit 101 into a plurality of areas, that is, horizontal four areas and vertical three areas, and determines each of the plurality of areas as the background area or the object area.

The area determination unit 102 counts the number of pixels having a gradation value not more than a predetermined threshold (hereinafter, referred to as gradation threshold), from pixels included in each of the plurality of areas.

When the number of pixels counted is not less than a predetermined threshold (hereinafter, referred to as pixel count threshold), the area is determined as the background area. For example, a black image is determined as the back the ground area. Furthermore, when the number of pixels having a gradation value not more than the gradation threshold is larger than the pixel count threshold, the area is determined as the object area. Determination results as the object area and the background area are used as image area information, for each of the functional blocks described later.

The gradation threshold is calculated from an image histogram of the acquired image. In the image histogram, a peak at a lowest gradation position is defined as the gradation threshold. In the present embodiment, the gradation threshold is set to 0, and the pixel count threshold is set to 1. The gradation threshold and the pixel count threshold are stored in the memory 108. Note that a process of determination is not limited to the above description. For example, an area having a maximum or average gradation value not more than the predetermined threshold may be defined as the background area. Furthermore, an area adjacent to an area determined as the object area may be defined as an object area.

Figure 2:
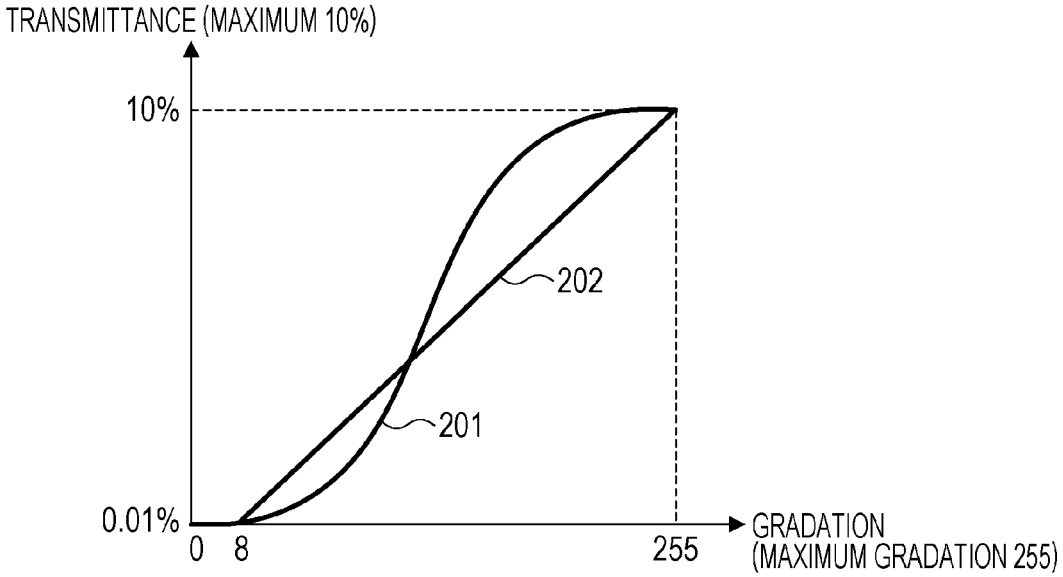
FIG. 2 is a graph illustrating a gradation characteristic of a liquid crystal panel according to the first embodiment of the present invention.

The correction value determination unit 103 uses the image area information obtained from the area determination unit 102, and a correction value obtained from the memory 108 to determine a gradation correction value for each area. A process of determining the gradation correction value for each area will be described below. FIG. 2 is a graph illustrating a gradation characteristic of the liquid crystal panel according to the present embodiment, the horizontal axis expresses input gradation, and the vertical axis represents transmittance of the liquid crystal panel.

The maximum gradation is 255, the maximum transmittance is 10%, and the contrast is 1000:1. When the gradation is 0, the transmittance is expressed as 10%/1000=0.01%. As the input gradation changes, a voltage value applied to each of liquid crystal elements of the liquid crystal panel is changed. Disorder of liquid-crystal molecular orientation is notably generated, when voltage applied to each of liquid crystal elements of the liquid crystal panel is especially small. A general gradation characteristic is illustrated by a curve 201 represented by an S-shaped curve. In the present embodiment, for simple description, a gradation characteristic represented by a straight line 202 is used, which is obtained as a result of linear interpolation of the curve 201.

As indicated by the straight line 202 of FIG. 2, the transmittance shows little change between gradation 0 and gradation 8. This means that, for substantial collective movement of the liquid-crystal molecules, a voltage not less than a predetermined voltage needs to be applied. As illustrated in FIG. 2, the liquid-crystal molecules are substantially collectively moved from gradation 8, and as the gradation increases, the transmittance of the liquid crystal panel is increased. Thus, in the liquid crystal panel according to the present embodiment, for alignment of orientation of the liquid-crystal molecules, a voltage corresponding to gradation value 8 is required. The gradation characteristic according to the present embodiment is expressed by formula (1), where the transmittance is y, and the gradation value is x.

[Equation 1]

$$y = 0.01(x < 8) \qquad (1)$$
$$y = \frac{(10 - 0.01)x}{(255 - 8)} - 0.31(x \geq 8)$$

In contrast, a value without showing uneven black display is different for the types of liquid crystal devices or display devices. Therefore, a gradation value without showing uneven black display is preliminarily measured, and the value is stored, as the correction value, in the memory 108. In the present embodiment, the measured gradation value without showing uneven black display is 16. The gradation value without showing uneven black display is larger than the gradation value (8) required for alignment of orientation of the liquid-crystal molecules.

The correction value determination unit 103 reads the correction value from the memory 108, and determines the value as the gradation correction value to be added to the gradation value of the background area. The gradation correction value has correction value information to be added to each area. The determined gradation correction value is stored in the memory 108. The correction value addition unit 104 adds the gradation correction value determined by the correction value determination unit 103 to a gradation value of an input image signal.

The liquid crystal panel unit 105 includes a liquid crystal driver, a control board configured to control the liquid crystal driver, and the liquid crystal panel. The liquid crystal panel unit 105 displays an image on a liquid crystal panel, based on the image signal after addition of the gradation correction value, the image signal being output by the correction value addition unit 104.

The luminance determination unit 106 determines a backlight luminance setting value, for each backlight control area. The luminance determination unit 106 obtains a luminance setting value set for the background area, and a luminance setting value set for the object area from the memory 108. The luminance determination unit 106 uses the image area information obtained from the area determination unit 102 to assign the luminance setting values to the background area and the object area. Specifically, the luminance determination unit 106 determines the backlight luminance setting value in the backlight control area corresponding to the background area to have a value smaller than the backlight luminance setting value in the backlight control area corresponding to the object area.

Then, the luminance determination unit 106 changes the backlight luminance setting value for the background area, according to the gradation correction value determined by the correction value determination unit 103. To a pixel having a gradation value of 0 before addition of the gradation correction value, the gradation correction value is added, and the pixel results in having a gradation value of 16. According to formula (1), the pixel results in having a liquid crystal transmittance of 0.34% by addition of the gradation correction value.

When the backlight luminance setting value is the same before and after the addition of the gradation correction value, display luminance is increased by an increase of the liquid crystal transmittance. Thus, the luminance determination unit 106 reduces the backlight luminance setting value by an increase of the liquid crystal transmittance to maintain the display luminance. In the present embodiment, black gradation is deteriorated 0.34/0.01=34 times by the gradation correction, and the luminance determination unit 106 reduces the backlight luminance setting value for the background area to 1/34.

Note that the amount of change in the backlight luminance setting value maintaining the display luminance according to the change of the liquid crystal transmittance is not limited to the above embodiment. The backlight luminance setting value is preferably changed, according to the change of the liquid crystal transmittance, based on the characteristics of the display devices.

As described above, the luminance determination unit 106 determines a luminance setting value for each of the plurality of areas, according to the gradation correction value determined by the correction value determination unit 103.

The backlight unit 107 is a lighting device which is divided into horizontal four control areas and vertical three control areas, and can separately control the amount of light emitted from each area. Each area has one or more light sources. Division into the control areas is not limited to the above description. The backlight unit 107 can preferably be controlled corresponding to the plurality of areas of the image. The backlight unit 107 emits, to the liquid crystal panel unit 105, light in an amount corresponding to the backlight luminance setting value determined by the luminance determination unit 106.

Note that the backlight unit 107 may control the amount of light emitted from the light source by pulse width modulation (PWM) of the light source. In such a configuration, the backlight luminance setting value is represented by a duty ratio (ratio between lighting period and extinction period) of the pulse width modulation. Further, the backlight unit 107 may control the amount of light emitted from the light source, setting a drive voltage value or a drive current value of the light source. In such a configuration, the backlight luminance setting value is represented by the drive voltage value or the drive current value. Still further, the backlight unit 107 may control the amount of light emitted from the light source, by the pulse width modulation of the light source, and setting the drive voltage value or the drive current value of the light source. In such a configuration, the backlight luminance setting value is represented by the duty ratio (ratio between lighting period and extinction period) of the pulse width modulation, and the drive voltage value or the drive current value.

The memory 108 stores setting values used for the functional blocks constituting the image display device 100. In the present embodiment, the memory 108 stores the above-described gradation threshold, pixel threshold, correction value, and the backlight luminance setting value.

Figure 3A:
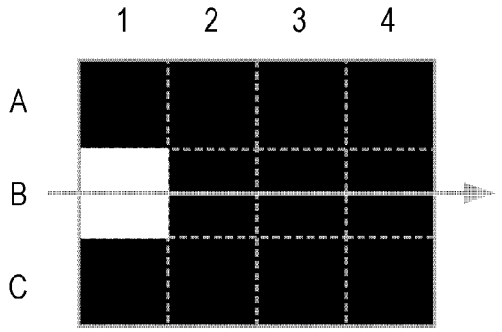
FIGS. 3A to 3D are schematic diagrams illustrating results of addition of a gradation correction value according to the first embodiment of the present invention.

FIGS. 3A to 3D are schematic diagrams illustrating the input image according to the present embodiment, and the gradation value, backlight luminance value, and the display luminance at areas B1 to B4. FIG. 3A is a schematic diagram illustrating the image according to the present embodiment and division of the image. The image is divided into the horizontal four areas and the vertical three areas, and represented as horizontal components 1 to 4 and vertical components A to C. In the present embodiment, the gradation value at the area B1 is 255, and the gradation value at the areas other than the area B1 is 0. The area determination unit 102 has a gradation threshold of 0 and a pixel count threshold of 1, and thus, the area B1 is determined as an object area B1. Furthermore, the other areas are determined as the background area.

Figure 3B:
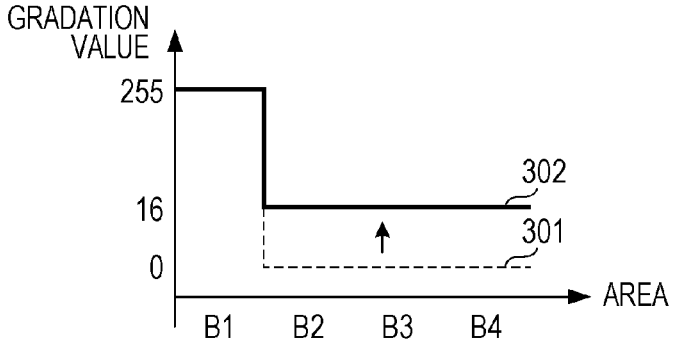

FIG. 3B is a graph illustrating the gradation values of the areas B1 to B4. A gradation value 301 represents the gradation value at each area before addition of the gradation correction value. A gradation value 302 represents the gradation value at each area after addition of the gradation correction value.

The correction value determination unit 103 reads the gradation value (16) without showing uneven black display recorded in the memory 108, and determines the value as the gradation correction value at the areas B2 to B4 determined as the background area. The correction value addition unit 104 performs addition of the gradation correction value determined by the correction value determination unit 103, at the areas B2 to B4 determined as the background area, and changes the gradation value from the gradation value 301 to the gradation value 302. Note that, in the present embodiment, the gradation correction value is not determined for the object area B1, but a correction value smaller than the correction value added to the background area may be used as the gradation correction value at the object area B1.

Figure 3C:
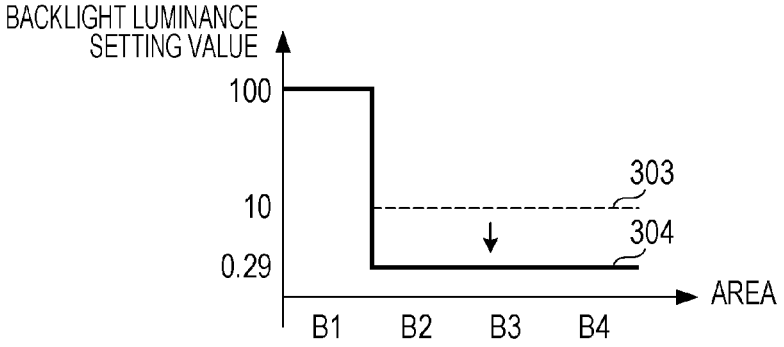

FIG. 3C is a graph illustrating processing for adjusting the backlight luminance setting value at the areas B1 to B4. The luminance determination unit 106 uses the image area information to set the backlight luminance setting value, and further uses the liquid crystal transmittance corresponding to the gradation correction values having been added to perform correction for reducing the backlight luminance setting value. The degree of reduction in backlight luminance setting value is determined by the liquid crystal transmittance corresponding to the gradation correction value having been added, as described in the basic operation of the luminance determination unit 106.

A backlight luminance setting value 303 represents a backlight luminance setting value which is set based on the image area information. Based on the backlight luminance setting value corresponding to the gradation value recorded in the memory 108, the luminance determination unit 106 defines the liquid crystal transmittance at the object area B1 as 100, and the liquid crystal transmittance at the background areas B2 to B4 as 10.

A backlight luminance setting value 304 represents a backlight luminance setting value which is determined by the luminance determination unit 106 based on the gradation correction value. The correction value addition unit 104 adds the gradation correction value at the background areas B2 to B4, and the gradation value at the background area is increased from 0 to 16. At this time, the amount of change in liquid crystal transmittance is 34 times larger than that before addition of the gradation correction value according to formula (1). The luminance determination unit 106 changes the backlight luminance setting value at the background areas B2 to B4 from 10 to 10/34=0.29. Thus, the display luminance at the background area in which the gradation correction value is added has a value approximately equivalent to that before addition of the gradation correction value, and the contrast is maintained.

Figure 3D:
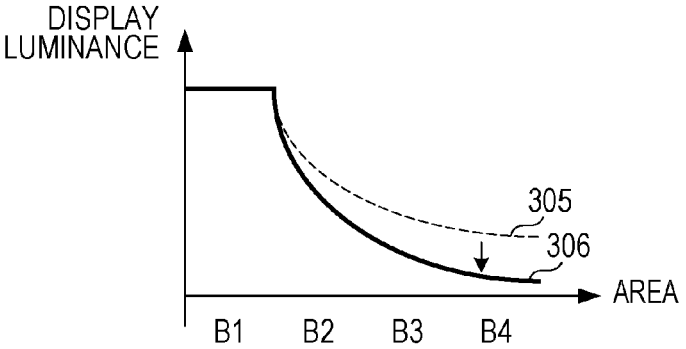

FIG. 3D is a graph illustrating display luminance at each area, before and after addition of the gradation correction value and change of the backlight luminance setting value. A display luminance 305 represents display luminance where light is emitted from the backlight unit 107 to which the backlight luminance setting value 303 is applied, to the liquid crystal panel unit 105 on which an image is displayed using the gradation value 301. The background areas B2 to B4 have black display, but actually have variation in liquid-crystal molecular orientation, and thus light emitted from the backlight unit 107 passes through the background areas and the display luminance 305 rises.

In contrast, a display luminance 306 represents display luminance where light is emitted from the backlight unit 107 to which the backlight luminance setting value 304 is applied, to the liquid crystal panel unit 105 on which an image is displayed using the gradation value 302 at each area after addition of the gradation correction value. The display luminance at background areas B2 to B4 is reduced relative to the display luminance 305, increasing the entire contrast ratio.

Note that, according to the present embodiment, the gradation correction value is added at all areas determined as the background area to change the backlight luminance setting value, but similar processing may be performed on part of the background areas. Specifically, the processing may be performed limitedly on an area adjacent to the peripheral edge portion of the liquid crystal panel, an area particularly expected to have the uneven blackness, found in preliminary measurement, or the like of the background areas.

As described above, according to the present embodiment, the amount of light emitted from the backlight is controlled, based on a result of determination of the areas in an image and a correction value added, in the image display device. More specifically, at the area in which the correction value is added, the backlight luminance value is reduced according to the correction value.

Thus, when the area having the uneven black display in the background area has alignment of the liquid crystal molecules, while maintaining the gradation of the object area, the uneven black display in the background area can be reduced. Furthermore, when the display luminance at the background area is maintained, the contrast of the entire displayed image is maintained. Thus, the uneven black display can be improved, while maintaining the gradation at an area having high luminance.

Second Embodiment

An image display device and a control method therefor according to a second embodiment of the present invention will be described. In the present embodiment, unevenness correction processing for an image, and local dimming for controlling luminance of backlight for a plurality of areas, in the image display system including an image output device and the image display device will be described.

Figure 4:
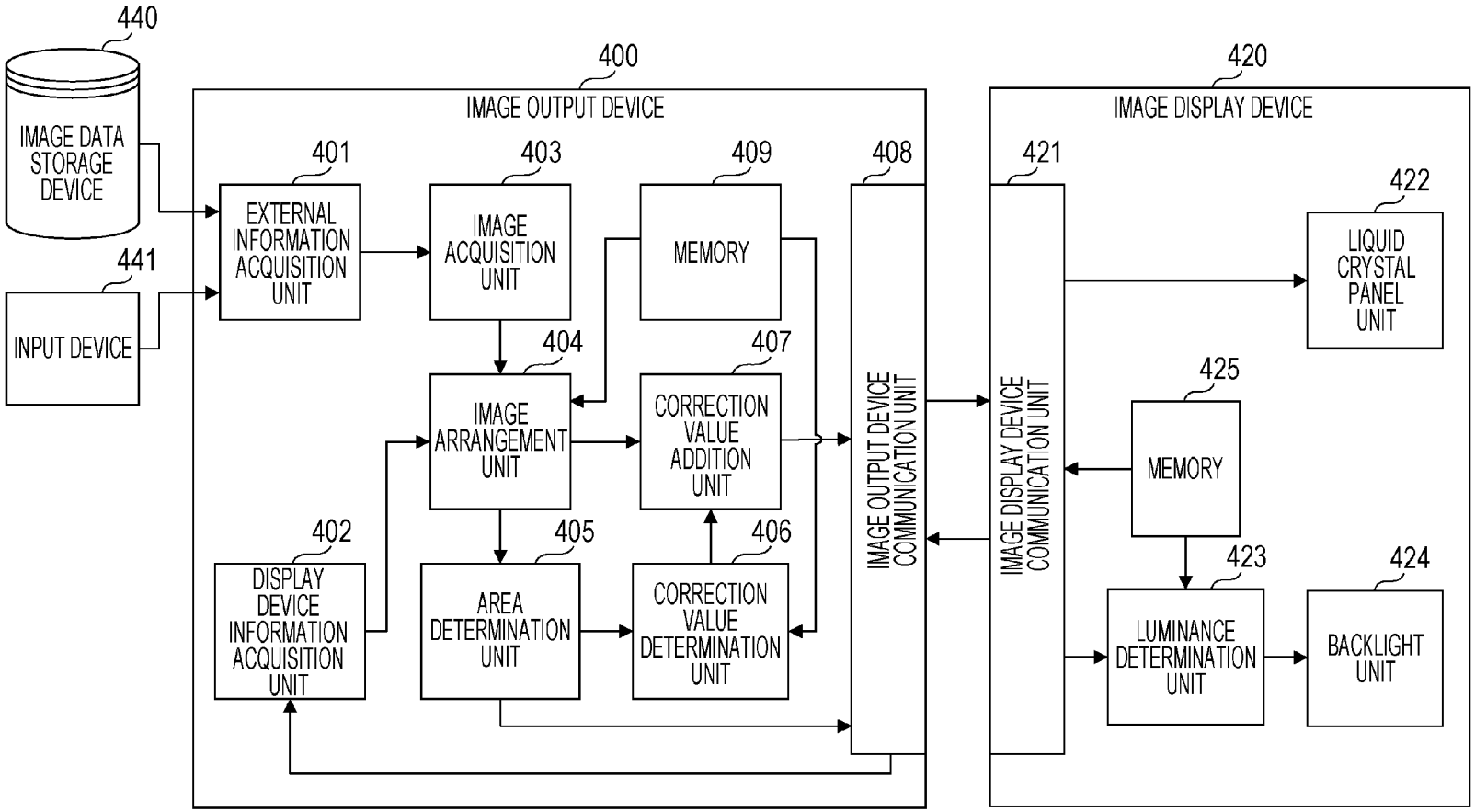
FIG. 4 is a block diagram illustrating a schematic configuration of an image display system according to a second embodiment of the present invention.

FIG. 4 is a block diagram illustrating a schematic configuration of the image display system according to the second embodiment of the present invention. The image display system according to the second embodiment includes the image output device 400, the image display device 420, and an image data storage device 440. Note that repetitive description of the same portions as the first embodiment will be omitted.

In the present embodiment, the image output device 400 performs arrangement of an image on the display panel, determination of the object area and the background area, determination and addition of the gradation correction value, and determination of the backlight luminance value. Furthermore, the image display device 420 displays the image according to the backlight luminance value determined by the image output device 400.

First, the image output device 400 includes an external information acquisition unit 401, a display device information acquisition unit 402, an image acquisition unit 403, an image arrangement unit 404, an area determination unit 405, a correction value determination unit 406, a correction value addition unit 407, an image output device communication unit 408, and a memory 409. Processing of the functional blocks in the image output device is performed by applications executed by the CPU not illustrated.

The external information acquisition unit 401 acquires an image from the image data storage device 440 connected to the image output device 400 which will be described later, and acquires information about user's operation to the application, from an input device 441 described later. The display device information acquisition unit 402 acquires a panel resolution of the image display device 420 stored in a memory 425 in the image display device 420 through the image output device communication unit 408.

The image acquisition unit 403 acquires the image from the external information acquisition unit 401. The image arrangement unit 404 arranges the image according to the panel resolution obtained from the display device information acquisition unit 402, and image arrangement information obtained from the memory 409. The image arrangement information is used for determination of an image display position according to the panel resolution and an image size.

In the present embodiment, a display area size and the image size are identical to each other. However, achievement of the present embodiment is not limited to the above description. For example, when the panel resolution is larger than the image size, the arrangement of the image is considered to be changed by user's operation. Hereinafter, image data after arrangement of the image is referred to as image data.

The area determination unit 405 determines the object area and the background area from the image data obtained from the image arrangement unit 404. The area determination unit 405 outputs a determination result, as the image area information, to the correction value determination unit 406 and the image output device communication unit 408. Similarly to the correction value determination unit 103 of the first embodiment, the correction value determination unit 406 obtains the image area information from the area determination unit 405, and determines a gradation correction value to be added to the background area. Specifically, a predetermined correction value is determined for an area determined as the background area. The gradation correction value is output to the correction value addition unit 407.

Similarly to the correction value addition unit 104 of the first embodiment, the correction value addition unit 407 adds the gradation correction value obtained from the correction value determination unit 406 to the gradation value of the background area of the image data obtained from the image arrangement unit 404.

The image output device communication unit 408 communicates with an image display device communication unit 421, and outputs image data after addition of the gradation correction value, the image data obtained from the correction value addition unit 407, and the gradation correction value to the image display device communication unit 421. In addition, the image output device communication unit 408 outputs the image area information obtained from the area determination unit 405 to the image display device communication unit 421.

The memory 409 stores setting values used for functional blocks constituting the image output device. In the present embodiment, the above-mentioned image arrangement information is stored. Furthermore, applications operated in the image output device 400 are also stored.

The image display device 420 includes the image display device communication unit 421, a liquid crystal panel unit 422, a luminance determination unit 423, a backlight unit 424, and the memory 425. Furthermore, the CPU not illustrated controls the overall operation of the functional blocks constituting the image display device 420.

The image display device communication unit 421 communicates with the image output device communication unit 408, and obtains the image data after addition of the gradation correction value, the gradation correction value, and the image area information, from the image output device communication unit 408. The image display device communication unit 421 outputs the image data after addition of the gradation correction value to the liquid crystal panel unit 422. Furthermore, the image display device communication unit 421 outputs the gradation correction value and the image area information to the luminance determination unit 423.

The liquid crystal panel unit 422 includes a liquid crystal driver, a control board obtaining the image data after addition of the gradation correction value, and controlling the liquid crystal driver, and the liquid crystal panel. The liquid crystal panel unit 422 displays the image data after addition of the gradation correction value, the image data being output from the correction value addition unit 407.

Similarly to the luminance determination unit 106 of the first embodiment, the luminance determination unit 423 determines a backlight luminance setting value for each backlight control area. Similar to the backlight unit 107 of the first embodiment, the backlight unit 424 is a lighting device divided into horizontal four areas and vertical three areas. Each of the areas of the backlight unit 424 has one or more light sources.

The memory 425 stores setting values used for the functional blocks constituting the image display device 420. The memory 425 stores the panel resolution, the correction value, the backlight luminance setting value for the background area, and the backlight luminance setting value for the object area. The image data storage device 440 is connected to a network, and transmits and receives the image data with another device connected to the same network. The input device 441 outputs information about user's operation input by the user to the external information acquisition unit 401.

Figure 5:
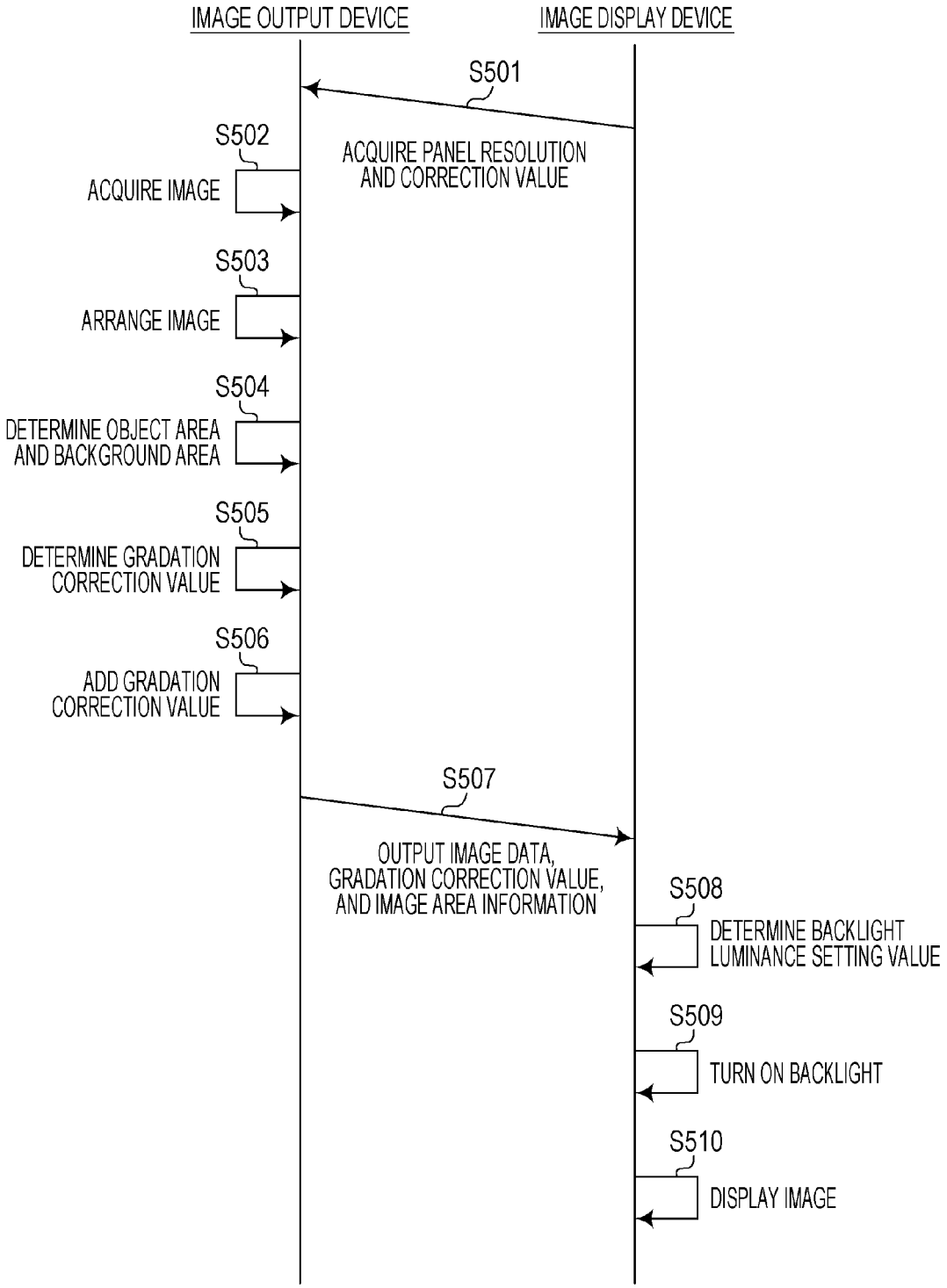
FIG. 5 is a sequence diagram illustrating unevenness correction processing upon display of an image obtained from an external device according to the second embodiment of the present invention.

FIG. 5 is a sequence diagram illustrating unevenness correction processing in the image output device when displaying the image obtained from the external device on the image display device in the image display system. The present processing is performed when the applications stored in the memory 409 are executed based on the information about user's operation acquired by the external information acquisition unit 401. The image output device communication unit 408 and the image display device communication unit 421 are connected wiredly or wirelessly, and communicably.

The display device information acquisition unit 402 acquires the panel resolution of the image display device 420 and the correction value which are stored in the memory 425, through the image output device communication unit 408 and the image display device communication unit 421 (S501). The external information acquisition unit 401 acquires the image from the image data storage device 440 connected to the image output device 400. Then the image acquisition unit 403 acquires the image acquired by the external information acquisition unit 401 (S502).

The image arrangement unit 404 refers to the panel resolution obtained from the display device information acquisition unit 402, and arranges the image acquired from the image acquisition unit 403 (S503). Then, the image data after the arrangement of the image is output to the correction value addition unit 407. The area determination unit 405 determines the object area and the background area from the image obtained from the image arrangement unit 404. A process of determination is similar to that of the first embodiment, and description will be omitted (S504). Then, a result of determination made by the area determination unit 405 is output as the image area information to the correction value determination unit 406 and the image output device communication unit 408.

The correction value determination unit 406 uses the image area information obtained from the area determination unit 405, and the correction value obtained from the memory 409 to determine the gradation correction value to be added to the background area (S505). The process of determining the gradation correction value is similar to that of the first embodiment. The correction value addition unit 407 uses the image data obtained from the image arrangement unit 404, and the gradation correction value obtained from the correction value determination unit 406 to add the gradation correction value to the gradation value at the background area (S506).

The image data after addition of the gradation correction value is output to the image output device communication unit 408. The image output device communication unit 408 outputs the image data, the gradation correction value, and the image area information to the image display device communication unit 421 (S507). When the image display device communication unit 421 obtains the image data, the luminance determination unit 423 determines a backlight luminance setting value. The determination process is similar to that of the first embodiment, and description thereof will be omitted (S508).

The backlight unit 424 turns on the backlight based on the backlight luminance setting value obtained from the luminance determination unit 423 (S509). The liquid crystal panel unit 422 uses the image data obtained from the image display device communication unit 421 to display the image after addition of the gradation correction value (S510).

Owing to the above configuration, in the image display device 420, the correction value is added only to the background area of the image, and at the area in which the correction value is added, based on the correction value added, the backlight luminance value can be reduced. Thus, when the area having the uneven black display in the background area has alignment of the liquid crystal molecules, while maintaining the gradation of the object area, the contrast of the entire displayed image can be maintained, and the uneven black display in the background area can be reduced.

Third Embodiment

An image display device and a control method therefor according to a third embodiment of the present invention will be described. In the third embodiment, description will be made of specifying, as a halo area, an area of the background areas greatly affected by a halo of the backlight, and adding, to the image display device of the first embodiment, non-addition processing of the gradation correction value to the halo area.

A halo phenomenon will be described. When a plurality of areas is extremely different in display luminance setting, the gradation value of the liquid crystal panel is changed for each area, and the backlight luminance setting value is changed for each area. Specifically, in an area set to high display luminance, an aperture ratio of the liquid crystal elements and backlight luminance are set higher, and at an area set to low display luminance, the aperture ratio of the liquid crystal elements and the backlight luminance are set lower. At this time, light of the area having a high backlight luminance setting value leaks to the area having a low backlight luminance setting value, in the vicinity of the area having a high backlight luminance setting value, and display luminance of the area set to low display luminance unexpectedly rises. This phenomenon is referred to as the halo phenomenon.

Figure 6:
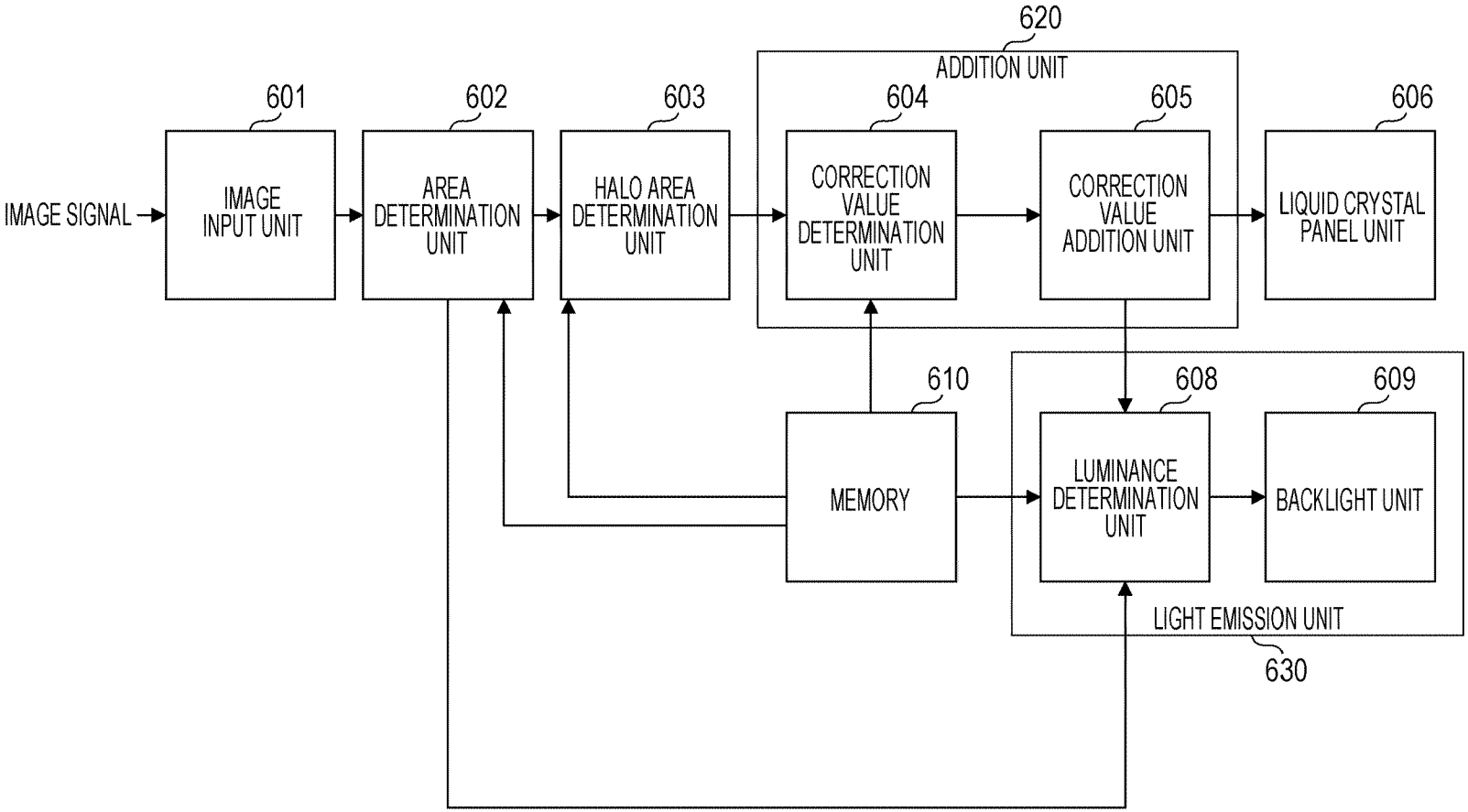
FIG. 6 is a block diagram illustrating a schematic configuration of an image display device according to a third embodiment of the present invention.

FIG. 6 is a block diagram illustrating a schematic configuration of the image display device 600 according to an embodiment of the present invention. The image display device 600 of FIG. 6 includes an image input unit 601, an area determination unit 602, a halo area determination unit 603, an addition unit 620, a liquid crystal panel unit 606, a light emission unit 630, and a memory 610. Furthermore, the addition unit 620 includes a correction value determination unit 604 and a correction value addition unit 605. The light emission unit 630 includes a luminance determination unit 608 and a backlight unit 609. The image display device 600 includes functional blocks controlled by a CPU not illustrated.

The functional blocks of FIG. 6 have the same functions as those of the blocks having the same names of the first embodiment, excluding the correction value determination unit 604 and the luminance determination unit 608. Description of the functions of the functional blocks having the same names as those of the functional blocks of the first embodiment will be omitted.

The halo area determination unit 603 determines an area greatly affected by the halo of the backlight, from the background areas determined by the area determination unit 602, and generates halo area information. Specifically, similarly to the first embodiment, the gradation correction value and a backlight setting value are determined for each of the object area and the background areas, from the image area information, based on a result of determination made by the area determination unit 602. Then, when a difference in backlight setting value between two adjacent areas has a value not less than a luminance setting threshold, an area having a lower backlight setting value of the two adjacent areas is determined as a halo area.

Description will be made using an embodiment of addition of the gradation correction value in the first embodiment illustrated in FIGS. 3A to 3C. As illustrated in FIG. 3B, similarly to the first embodiment, the gradation correction value is added to the background areas B2 to B4, and the backlight luminance setting value is corrected, as illustrated in FIG. 3C.

When a difference between the backlight luminance setting value for an adjacent area and the backlight setting value for a determination area is not less than the luminance setting threshold, the halo area determination unit 603 determines a corresponding area as the halo area. In the present embodiment, the luminance setting threshold is 90. Based on the backlight luminance setting value 304 after changing illustrated in FIG. 3C, a difference between the background area B2 and the object area B1 results in 100−0.29=99.7 in backlight setting value. Thus, the background area B2 is determined as the halo area.

The luminance setting threshold is a value determined by a characteristic of a liquid crystal panel. The liquid crystal panel is evaluated previously, comparison is made between a difference in backlight luminance setting value and the halo phenomenon, and a difference in backlight luminance setting value causing conspicuous halo phenomenon is determined as the luminance setting threshold. In the present embodiment, the luminance setting threshold previously experimentally obtained is stored in the memory 610.

Note that, a process of determining the halo area is not limited to the above description. A background area adjacent to the object area may be determined as the halo area, based on the image area information determined by the area determination unit 602. Furthermore, similarly to the first embodiment, the gradation correction value and a first backlight setting value may be determined based on the image area information to determine the halo area based on the first backlight setting value.

The correction value determination unit 604 obtains the image signal, the image area information, and the halo area information, from the halo area determination unit 603. The correction value determination unit 604 defines a correction value read from the memory 610 as the gradation correction value for the gradation value of a background area not determined as the halo area. Note that, in the present embodiment, the gradation correction value is not determined for the object area and the halo area, but a correction value smaller than the correction value determined for the background area may be defined as a correction value for the object area B1 and a halo area B2, similarly to the first embodiment.

The correction value determination unit 604 determines a value linearly connecting a gradation correction value for the halo area and the gradation correction value for the background area, as a correction value, for a background area adjacent to the halo area. Note that, the gradation correction value for the background area adjacent to the halo area preferably interpolates between the gradation correction value for the halo area and the gradation correction value for the background area, and is not limited to the linear connection. The gradation correction value for the background area adjacent to the halo area may be a correction value connecting the gradation correction value for the halo area and the gradation correction value for the background area by a curve. The correction value addition unit 605 adds the gradation correction value determined by the determination unit 604 to the gradation value of each area.

The luminance determination unit 608 determines a backlight luminance setting value for each backlight control area, based on the gradation value at each area after addition of the gradation correction value, the image area information, and the halo area information. The luminance determination unit 608 uses the gradation value at the background area after addition of the gradation correction value to determine the backlight luminance setting value, for the halo area and the background area adjacent to the halo area.

Figure 7A:
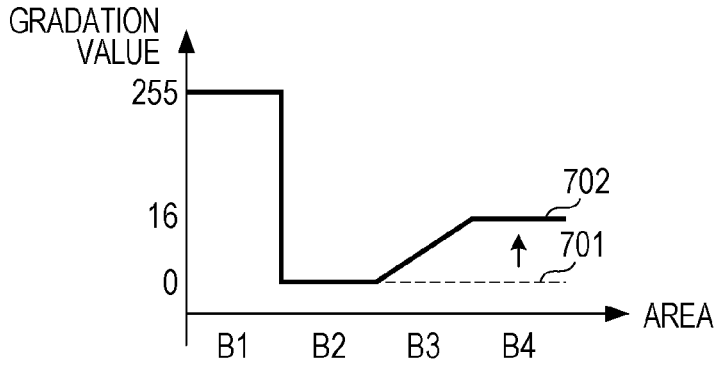
FIGS. 7A to 7C are graphs illustrating results of addition of a gradation correction value and change of backlight luminance according to the third embodiment of the present invention.
Figure 7B:
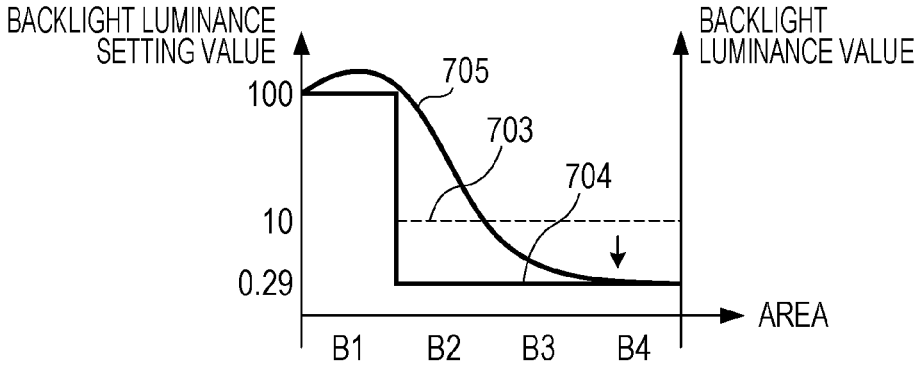
Figure 7C:
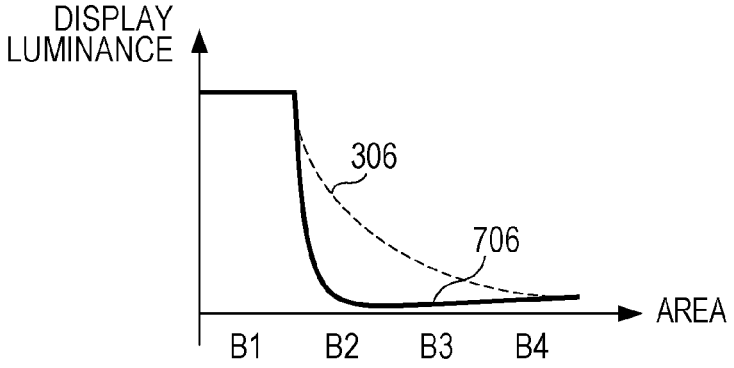

In FIGS. 7A to 7C, results of addition of the gradation correction value and change of the backlight luminance according to the present embodiment is illustrated. Division of the image and the backlight according to the present embodiment is similar to FIG. 3A. As described above, the areas B1 to B4 are determined as the object area B1, the halo area B2, and the background areas B3 and B4, by the area determination unit 602 and the halo area determination unit 603.

FIG. 7A is a graph illustrating a gradation value at the object area B1, the halo area B2, and the background areas B3 and B4. A broken line represents a gradation value 701 of each area before addition of the gradation correction value. Furthermore, a solid line represents a gradation value 702 at each area after addition of the gradation correction value. The gradation value at the object area B1 is 255 before addition of the gradation correction value, and the gradation value at the areas B2, B3, and B4 other than the object area is 0.

The correction value determination unit 604 determines 0 as the gradation correction value at the halo area B2. Furthermore, the correction value at the background areas is similar to the first embodiment, and 16 is determined as the gradation correction value. In the background area B3, a value linearly connecting the gradation correction value (0) for the area B2 and the gradation correction value (16) for the area B4 is determined as the gradation correction value. The gradation correction value is not determined at the object area B1. The correction value addition unit 605 adds the above-mentioned gradation correction value to the gradation value of each area. Thus, the gradation value at each area after addition of the gradation correction value is changed from the gradation value 701 to the gradation value 702.

FIG. 7B is a graph illustrating the backlight luminance setting value of the object area B1, the halo area B2, and the background areas B3 and B4 and the backlight luminance value based on the backlight luminance setting value. A broken line represents a backlight luminance setting value 703, where predetermined backlight luminance value is set at the object area and the background area based on a result of the determination made by the area determination unit 602. A solid line represents a backlight luminance setting value 704 after determination of the luminance, determined by the luminance determination unit 608.

Furthermore, a backlight luminance value 705 is a backlight luminance value of backlight emitted to the liquid crystal panel unit upon drive of the backlight unit with a backlight luminance setting value for each area indicated by the backlight luminance setting value 704. The backlight luminance value 705 represents a result of backlight luminance at each area to which leaked light from an adjacent area is added, based on the backlight luminance setting value 704.

Similarly to the first embodiment, the luminance determination unit 608 reduces the backlight luminance setting value at the background area B4 according to an increase of the gradation correction value. Specifically, the backlight luminance setting value is changed from 10 to 0.29. Furthermore, the luminance determination unit 608 uses the gradation correction value at the background area B4 to control the backlight luminance setting value for the halo area B2 and the background area B3 adjacent to the halo area. Thus, the backlight luminance setting value at the halo area B2 and the background area B3 is changed from 10 to 0.29.

FIG. 7C is a graph illustrating the display luminance at the object area B1, the halo area B2, and the background areas B3 and B4. A display luminance 706 represented by a solid line shows a result of emission of light from the backlight unit having the backlight luminance value 705 of FIG. 7B, to the liquid crystal panel unit 606 having a liquid crystal transmittance corresponding to the gradation value 702 of FIG. 7A. The display luminance 306 of the first embodiment is display luminance without performance of determination and correction of the halo area.

Compared with the display luminance 306, in the display luminance 706 according to the present embodiment, the display luminance is reduced at the halo area B2, and the increase of the display luminance caused by the leaked light from the area B1 is inhibited. Note that, when the area B2 has the uneven black display, the luminance at the object area B1 adjacent to the area B2 is high, and the uneven black display at the area adjacent thereto is made inconspicuous.

As described above, in the image display device, the amount of light emitted from the backlight is controlled based on a result of the determination of the areas in an image and a correction value added. Specifically, at the area in which the correction value is added, the backlight luminance value is reduced according to the correction value. Thus, while maintaining the gradation of the object area, unevenness can be corrected, and the contrast of the entire displayed image can be maintained.

Furthermore, addition of the correction value to the halo area determined from the background areas and the background area adjacent to the halo area, respectively allows the prevention of the halo affecting the background area, caused by the backlight from the object area.

Fourth Embodiment

An image display device and a control method therefor according to a fourth embodiment of the present invention will be described. In the fourth embodiment, description will be made of specifying a halo area of the background areas greatly affected by the halo of the backlight, as a halo area, and adding non-addition processing of the gradation correction value to the halo area, in addition to the processing of the second embodiment.

Figure 8:
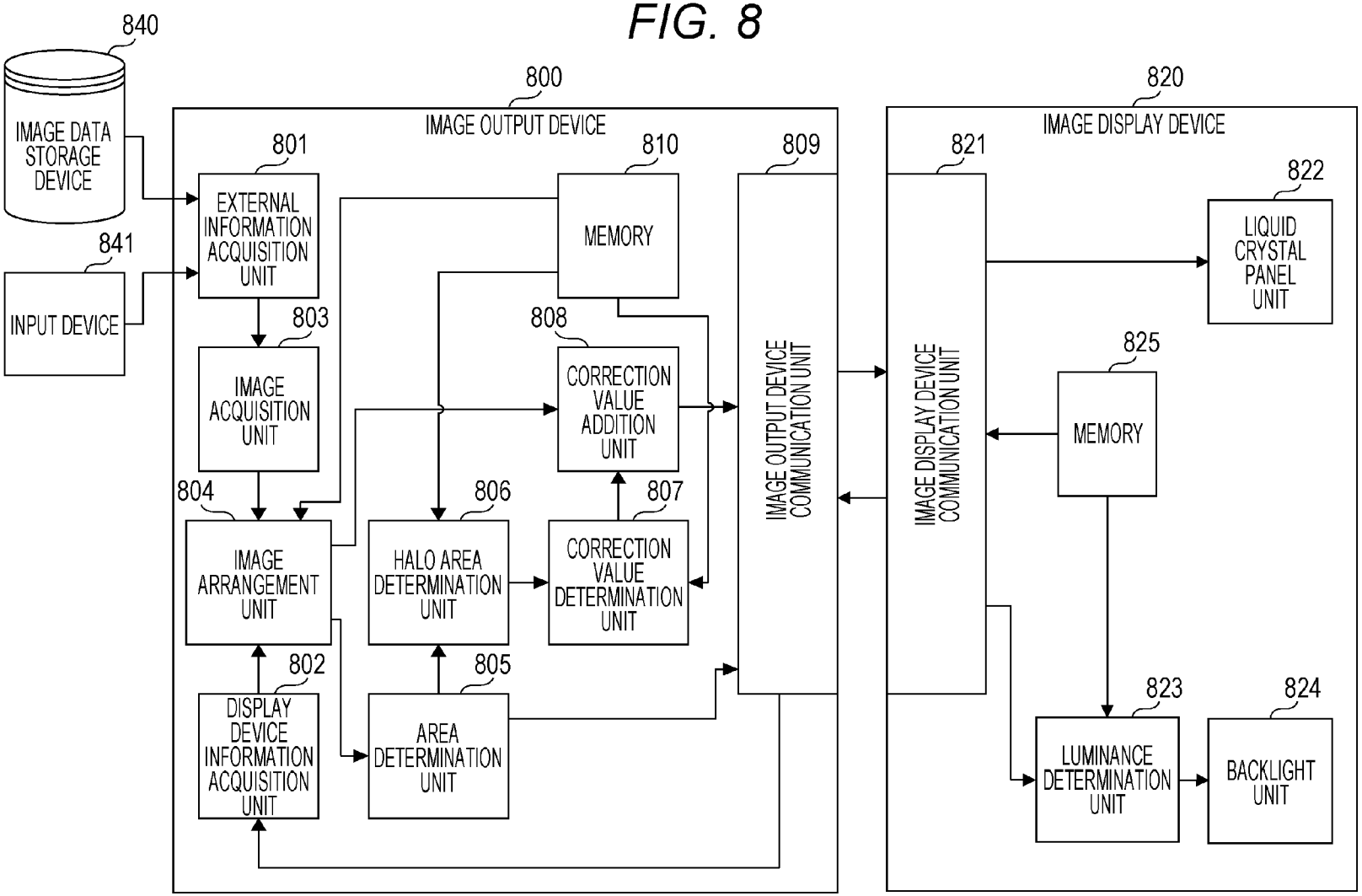
FIG. 8 is a block diagram illustrating a schematic configuration of an image display system according to a fourth embodiment of the present invention.

FIG. 8 is a block diagram illustrating a schematic configuration of the image display system according to the fourth embodiment. The image display system according to the fourth embodiment includes an image output device 800 and an image display device 820. The functional blocks of FIG. 8 have the same functions as those of the blocks having the same names of the second embodiment, excluding a correction value determination unit 807. In addition, a halo area determination unit 806 is added. The halo area determination unit 806 determines an area greatly affected by a halo of the backlight of the background areas, and generates the halo area information. A process of determining the halo area is similar to the third embodiment.

The correction value determination unit 807 obtains the image area information and the halo area information from the halo area determination unit 806. Then, the correction value determination unit 807 reads the correction value from the memory 810, and determines the value as the gradation correction value to be added to the gradation value at the background area. A process of determining the gradation correction value at each background area, object area, and halo area is similar to the correction value determination unit 604 of the third embodiment. The correction value determination unit 807 determines the predetermined correction values as the gradation correction value at the object area and the background area, and further the gradation correction value to be added to the area determined as the halo area by the halo area determination unit 806 is set to 0.

As described above, in the image display system according to the present embodiment, the amount of light emitted from the backlight is controlled based on a result of the determination of the areas in an image and a correction value added. Specifically, at the area in which the correction value is added, the backlight luminance value is reduced according to the correction value. Thus, while maintaining the gradation at the object area, unevenness can be corrected, and the contrast of the entire displayed image can be maintained.

Furthermore, addition of the correction value to each of the halo area determined from the background areas and the background area adjacent to the halo area allows the prevention of the halo affecting the background area, caused by the backlight from the object area.

Fifth Embodiment

An image display device and a control method therefor according to a fifth embodiment of the present invention will be described. In the present embodiment, the correction value at the background area is determined by luminance estimation calculation.

Figure 9:
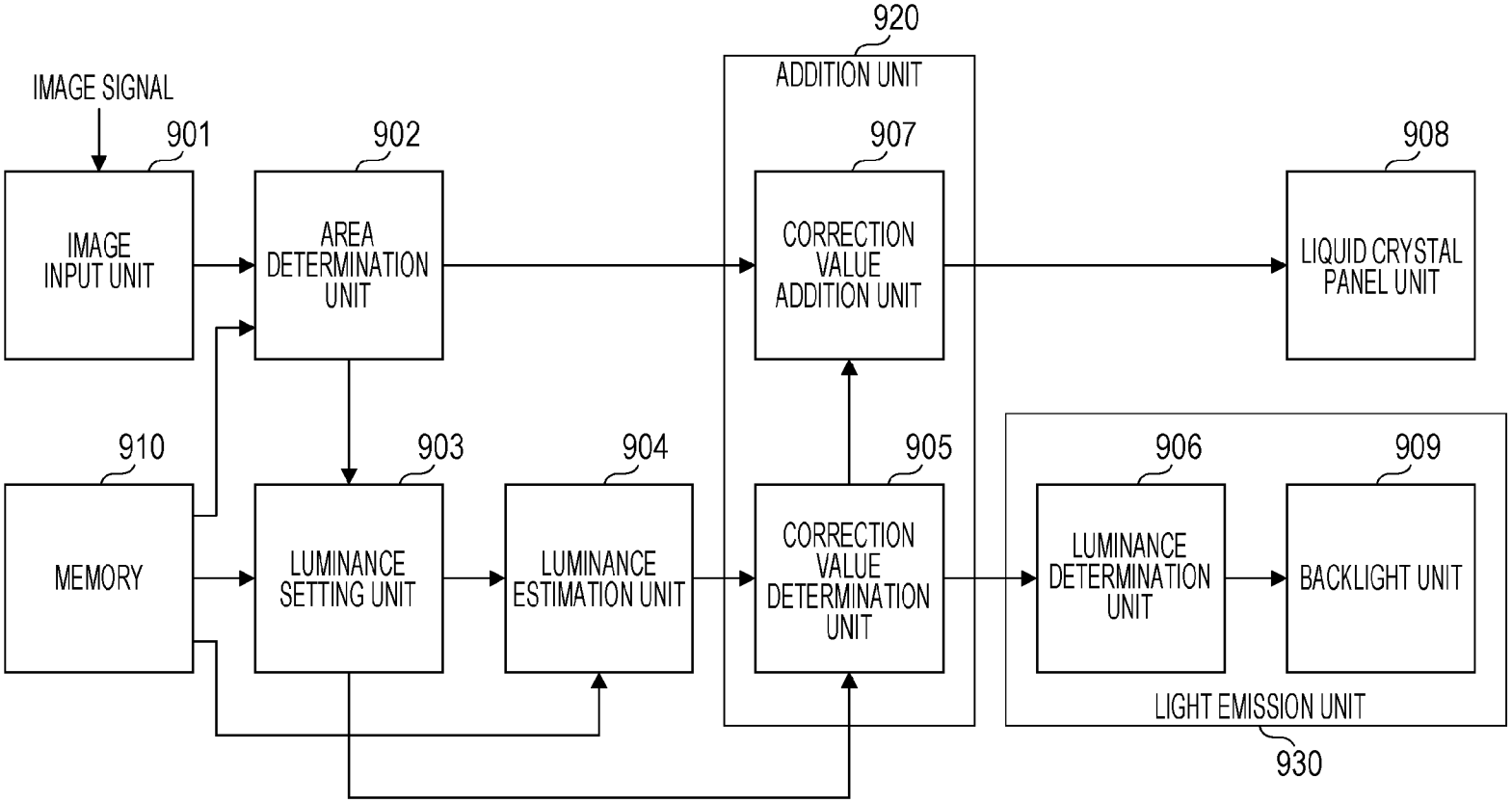
FIG. 9 is a block diagram illustrating a schematic configuration of an image display device according to a fifth embodiment of the present invention.

FIG. 9 is a block diagram illustrating a schematic configuration of the image display device 900 according to the present embodiment. The image display device 900 of FIG. 9 includes an image input unit 901, an area determination unit 902, a luminance setting unit 903, a luminance estimation unit 904, an addition unit 920, a liquid crystal panel unit 908, a light emission unit 930, and a memory 910. The addition unit 920 includes a correction value determination unit 905 and a correction value addition unit 907. The light emission unit 930 includes a luminance determination unit 906 and a backlight unit 909. The image display device 900 includes functional blocks controlled by a CPU not illustrated.

The functional blocks of FIG. 9 have the same functions as those of the blocks having the same names of the first embodiment, excluding the correction value determination unit 905 and the luminance determination unit 906. In addition, the luminance setting unit 903 and the luminance estimation unit 904 are added. Description of the functions of the functional blocks having the same names as those of the functional blocks of the first embodiment will be omitted.

The luminance setting unit 903 determines a first backlight luminance setting value for each of the backlight control areas corresponding to the background area and object area of the image, based on a determination result of the area determination unit 902. The luminance estimation unit 904 estimates the luminance of light made incident to the liquid crystal panel unit 908 from the backlight unit 909 turned on based on the first backlight luminance setting value.

Luminance estimation processing of the luminance estimation unit 904 will be described below. In the present embodiment, a luminance estimation point is positioned at the center point of each area obtained by dividing the whole liquid crystal panel, corresponding to the backlight control area. When the backlight of each area is turned on, the luminance estimation unit 904 stores, as an attenuation coefficient, in the memory 910, an attenuation rate at the estimation points corresponding to areas around the area where the backlight is turned on.

The luminance estimation unit 904 multiplies the attenuation coefficient read from the memory 910 and the first backlight luminance setting value determined by the luminance setting unit 903 together at each area. Results of the multiplication are all added together to obtain backlight luminance estimation values at the estimation points of respective areas.

In the present embodiment, similarly to the first embodiment, the backlight unit 909 is divided into a total of 12 areas, that is, horizontal four areas and vertical three areas. For 12 backlight control areas, the luminance estimation unit 904 multiplies backlight luminance value and attenuation coefficient together, at the estimation points, and adds all the results together to estimate a luminance at one estimation point. There are 12 estimation points corresponding to the backlight control areas. Thus, the results of calculation at all estimation points are output, as the luminance estimation value, to the correction value determination unit 905.

Figure 10:
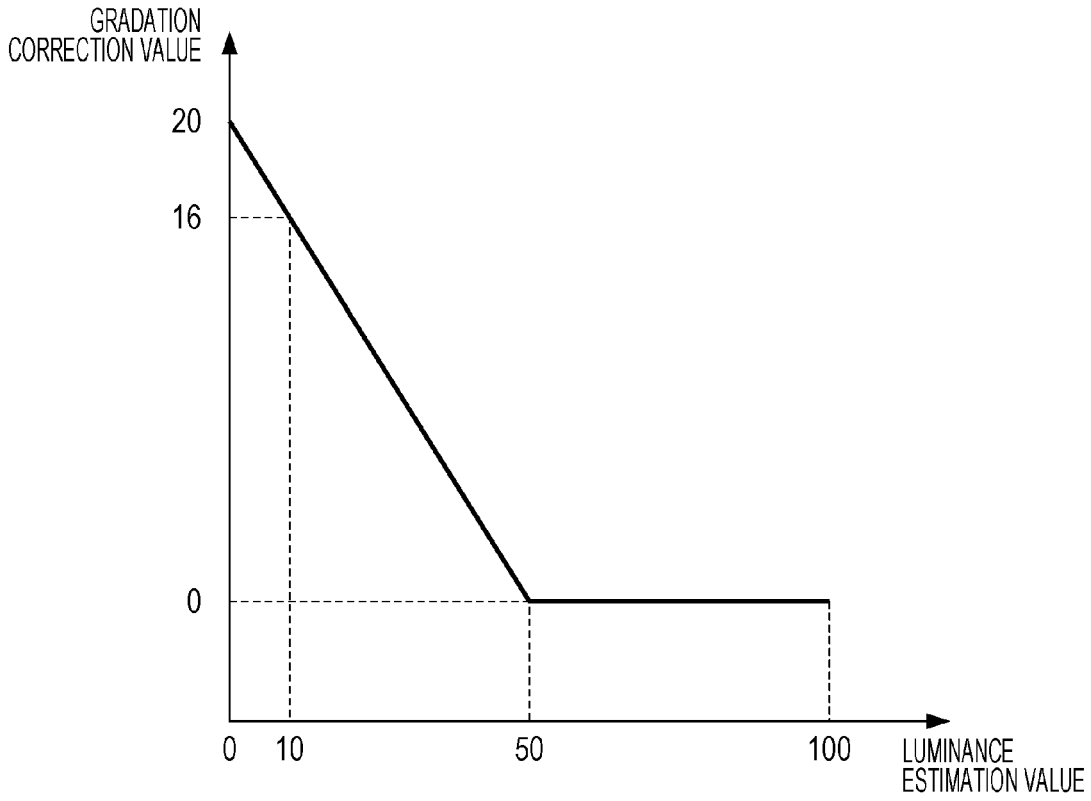
FIG. 10 is a graph illustrating a relationship between a luminance estimation value and a gradation correction value according to the fifth embodiment of the present invention.

The correction value determination unit 905 obtains a gradation correction value for the image data, based on the luminance estimation value at respective points calculated by the luminance estimation unit 904. For calculation of the gradation correction value using the luminance estimation value, a conversion table between the luminance estimation value and the gradation correction value is used. In FIG. 10, an embodiment of the conversion table is illustrated. When the luminance estimation value is between 0 and 50, the gradation correction value linearly drops from 20 to 0. In addition, when the luminance estimation value is between 50 and 100, the gradation correction value is 0. Thus, an area having a lower luminance estimation value has a larger gradation correction value.

The luminance determination unit 906 determines a second backlight luminance setting value, based on the gradation correction value obtained from the correction value determination unit 905 and object image area information. The second backlight luminance setting value is determined by correction of the first backlight luminance setting value so that display luminance at the background area to which the gradation correction value is added maintains display luminance before addition of the gradation correction value.

Figure 11A:
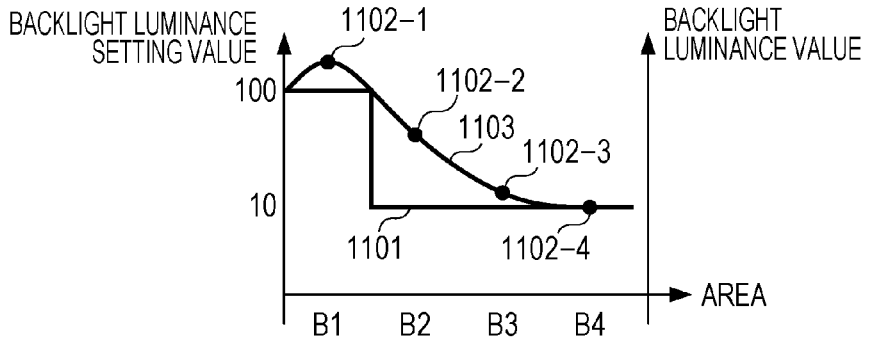
FIGS. 11A to 11D are graphs illustrating results of addition of a gradation correction value and change of backlight luminance according to the fifth embodiment of the present invention.

In FIGS. 11A to 11D, addition of the gradation correction value and change of the backlight luminance according to the present embodiment are illustrated. In the present embodiment, the input image is the image illustrated in FIG. 3A of the first embodiment. The area determination unit 902 determines the areas of the input image, as the object area B1 and the background areas B2, B3, and B4. FIG. 11A is a graph illustrating the first backlight luminance setting value and the luminance estimation value obtained from the first backlight luminance setting value in respective areas. The luminance setting unit 903 reads the correction value at each area stored in the memory 910, and sets the first backlight luminance setting value 1101 based on a determination result of the area determination unit 902.

The luminance estimation unit 904 uses the attenuation coefficients stored in the memory 910, and the first backlight luminance setting value 1101 obtained from the luminance setting unit 903 to obtain the luminance estimation values 1102-1 to 1102-4 at the center of the respective areas. Luminance estimation values 1102-1 to 1102-4 are interpolated to obtain a luminance estimation value 1103. In the present embodiment, the luminance estimation value 1102-4 is 10 similar to the first backlight luminance setting value 1101, and the luminance estimation value 1102-2 is 20.

Figure 11B:
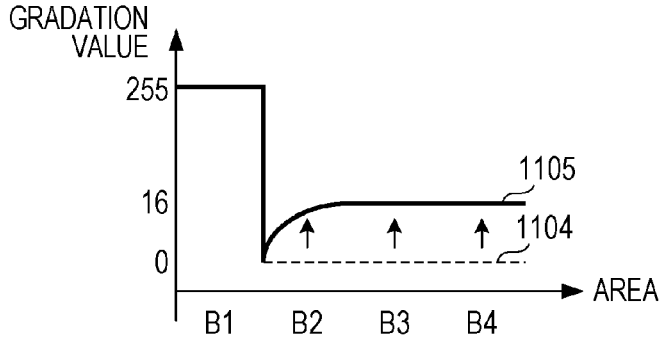

FIG. 11B is a schematic diagram illustrating a gradation value at each area before and after addition of the gradation correction value. The correction value determination unit 905 uses the luminance estimation value 1103 obtained from the luminance estimation unit 904, and the conversion table between the luminance estimation values and the gradation correction values, read from the memory 910, to determine a gradation correction value for each area.

The luminance estimation value at the object area B1 is not less than 100, so that the gradation correction value at the object area B1 is converted to 0 based on the conversion table of FIG. 10. Therefore, the luminance estimation value at the background areas B2, B3, and B4 is reduced from 100 to 10. Thus, the gradation correction value at the background areas B2, B3, and B4 is determined to be 0 to 16, based on the luminance estimation values and the conversion table between the luminance estimation values and the gradation correction values. The correction value addition unit 907 adds a gradation correction value obtained from the correction value determination unit 905 to a gradation value 1104 of each area obtained from the area determination unit 902, and obtains a gradation value 1105 after addition of the gradation correction value.

Figure 11C:
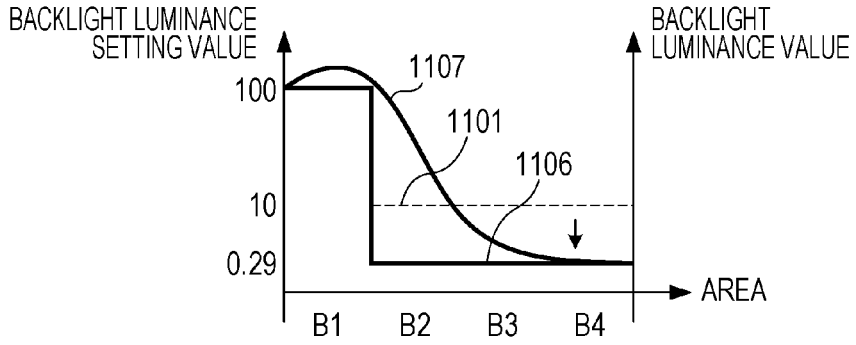

FIG. 11C is a schematic diagram illustrating a second backlight luminance setting value 1106 at each area, and a backlight luminance value 1107 of backlight made incident to the liquid crystal panel unit 908 upon turning on the backlight unit 909, obtained using the second backlight luminance setting value 1106. The luminance determination unit 906 corrects the first backlight luminance setting value 1101, based on the gradation value 1105 obtained by addition of the gradation correction value performed by the correction value addition unit 907, and determines the second backlight luminance setting value 1106.

In the present embodiment, amounts of correction of the first backlight luminance setting value at the background areas B2, B3, and B4 is obtained using the gradation value at the background area B4 having a maximum gradation correction value. Similar to the first embodiment, the liquid crystal transmittance at the background area B4 results in 0.34%, as a result of addition of the gradation correction value (16), so that the luminance determination unit 906 determines the first backlight luminance setting value at the background areas B2, B3, and B4 as 10/34=0.29.

Thus, addition of the leaked light from the adjacent area, to the second backlight luminance setting value 1106 provides the backlight luminance value 1107 of backlight made incident to the liquid crystal panel unit 908. Note that, in the present embodiment, the backlight setting value is controlled using the gradation value at the area B4, but a result of addition of the gradation correction value using luminance estimation may be used to change the backlight luminance setting value at each area.

Figure 11D:
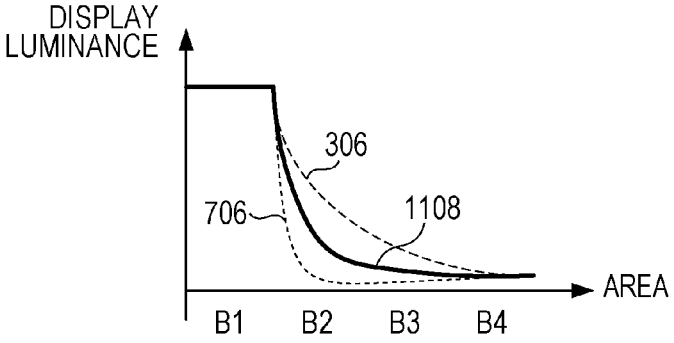

FIG. 11D is a schematic diagram illustrating the display luminance according to the present embodiment. The display luminance represented by display luminance 1108 is obtained by emitting light from the backlight unit 909 using the backlight luminance setting value 1106 of FIG. 11C, to the liquid crystal panel unit 908 having a liquid crystal transmittance corresponding to the gradation value 1105 of FIG. 11B.

The display luminance 306 of FIG. 11D is the display luminance obtained in the first embodiment, and the display luminance 706 is the display luminance obtained in the third embodiment. At background area B2, the display luminance 1108 is lower than the display luminance 306, so that the halo caused by the leaked light from the object area B1 is made inconspicuous compared with the first embodiment.

In the third embodiment, backlight luminance setting value is subtracted without adding the gradation correction value to the background area B2, and thus, the display luminance 706 is lowered. However, since the display luminance 1108 according to the present embodiment is obtained by addition of the gradation correction value calculated using the luminance estimation value, more natural display luminance can be maintained.

As described above, in the image display device, the amount of light emitted from the backlight is controlled based on a result of the determination of the areas in an image and a correction value added. Specifically, in the area in which the correction value is added, the backlight luminance value is reduced according to the correction value. Thus, while maintaining the gradation of the object area, unevenness can be corrected, and the contrast of the entire displayed image can be maintained.

Furthermore, uneven black display can be inhibited in the image display device without preliminarily storing the gradation correction value in the memory or the like. Still further, even if the gradation correction value is changed due to an external factor such as an external pressure to the display device, an accurate gradation correction value suitable for an actual condition can be calculated for further accurate unevenness correction.

Sixth Embodiment

Figure 12:
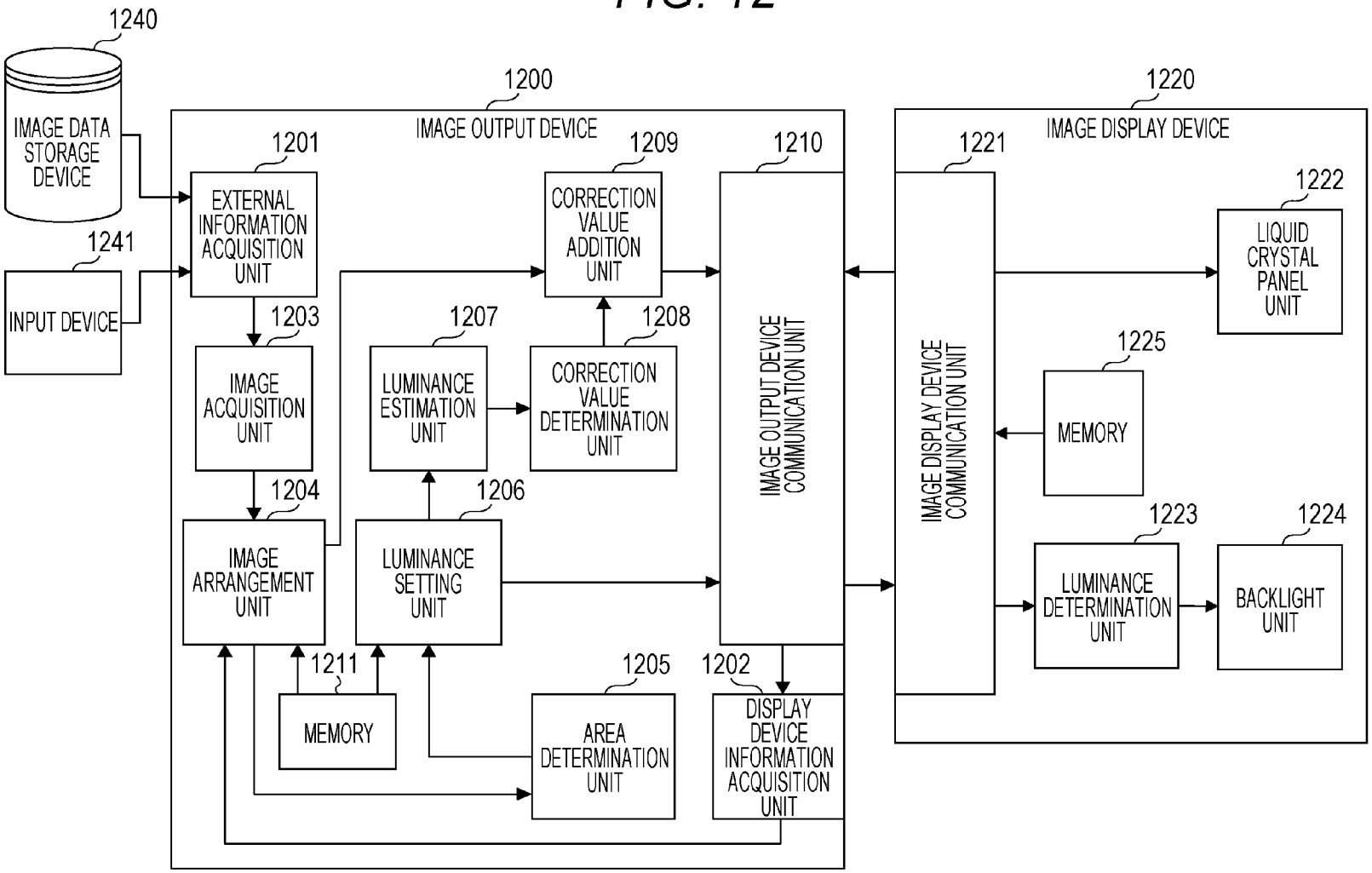
FIG. 12 is a block diagram illustrating a schematic configuration of an image display system according to a sixth embodiment of the present invention.

An image display device and a control method therefor according to a sixth embodiment of the present invention will be described below. In addition to the processing of the second embodiment, determination of the correction value at the background area with luminance estimation calculation will be described in the sixth embodiment. FIG. 12 is a block diagram illustrating a schematic configuration of an image display system which includes an image output device 1200, an image display device 1220, and an image data storage device 1240 according to the sixth embodiment of the present invention.

The functional blocks of FIG. 12 have the same functions as those of the blocks having the same names of the second embodiment of FIG. 4, excluding a luminance determination unit 1206 and a correction value determination unit 1208.

However, a luminance estimation unit 1207 is added to the image output device 1200. In addition, a luminance determination unit 1223 is added to the image display device 1220.

Similar to the luminance determination unit 906 of the fifth embodiment, the luminance determination unit 1206 determines a backlight luminance setting value for each backlight control area. Similar to the luminance estimation unit 904 of the fifth embodiment, the luminance estimation unit 1207 estimates the luminance of light made incident to the liquid crystal panel unit 1222 from the backlight unit 1224 turned on.

The correction value determination unit 1208 obtains, similar to the correction value determination unit 905 of the fifth embodiment, the gradation correction value for the image data based on the luminance estimation value at each point calculated by the luminance estimation unit 1207. The luminance determination unit 1223 corrects, similar to the luminance determination unit 906 of the fifth embodiment, the backlight luminance setting value based on the gradation correction value and the image area information obtained.

As described above, in the image display device, the amount of light emitted from the backlight is controlled based on a result of the determination of the areas in an image and a correction value added. Specifically, in the area to which the correction value is added, the backlight luminance value is reduced according to the correction value. Thus, while maintaining the gradation of the object area, unevenness can be corrected, and the contrast of the entire displayed image can be maintained.

Furthermore, uneven black display can be inhibited in the image display device without preliminarily storing the gradation correction value in the memory or the like. Still further, even if the gradation correction value is changed due to an external factor such as an external pressure to the display device, an accurate gradation correction value suitable for an actual condition can be calculated for further accurate unevenness correction.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-094403, filed May 1, 2015, which is hereby incorporated by reference herein in its entirety.

What is claimed is:

1. An image display device comprising:

a plurality of light emission units configured to be separately controlled in light emission;

a display panel having a plurality of display areas corresponding to the plurality of light emission units, and configured to transmit light emitted from the plurality of light emission units to display an image based on a display image signal;

a determination unit configured to determine whether the plurality of display areas is a first area satisfying a predetermined condition or a second area having luminance lower than that of the first area, respectively, based on an input image signal;

a light emission control unit configured to control light emitted from the plurality of light emission units to reduce an amount of light emitted from a light emission unit corresponding to the second area relative to an amount of light emitted from a light emission unit corresponding to the first area; and a correction unit configured to output the display image signal to the display panel, the display image signal being obtained by adding a first correction value to a portion of the input image signal corresponding to all the second area.

2. The image display device according to claim 1, wherein the light emission control unit controls an amount of light emitted from a light emission unit corresponding to the second area based on the first correction value.

3. The image display device according to claim 1, wherein the correction unit does not add a correction value to the first area.

4. The image display device according to claim 1, further comprising a second determination unit configured to determine a second area as a third area, when an amount of light emitted from the light emission unit corresponding to the first area is larger than a predetermined value relative to an amount of light emitted from the light emission unit corresponding to the second area adjacent to the first area, wherein the correction unit adds a third correction value to the third area, the third correction value being smaller than the first correction value.

5. The image display device according to claim 4, wherein the correction unit defines the third correction value as 0.

6. The image display device according to claim 4, wherein the correction unit adds a fourth correction value for interpolation between the third correction value and the first correction value, to the second area adjacent to the third area.

7. The image display device according to claim 6, wherein the fourth correction value to be added to the second area adjacent to the third area linearly interpolates between the third correction value and the first correction value.

8. The image display device according to claim 1, wherein the light emission control unit controls light emitted from the plurality of light emission units so that the display luminance at the second area to which the first correction value is added maintains display luminance of display using the input image signal before addition of the first correction value.

9. The image display device according to claim 1, wherein when number of pixels having a gradation value not more than a predetermined gradation value included in a display area to be determined, of the plurality of display areas, is less than a predetermined threshold, the determination unit determines that the display area is the first area, and when the number of pixels is not less than the predetermined threshold, the determination unit determines that the display area is the second area.

10. The image display device according to claim 1, wherein when a maximum value of gradation values of pixels included in a display area to be determined, of the plurality of display areas, is larger than a predetermined threshold, the determination unit determines that the display area is the first area, and when the maximum value of the gradation value is not more than the predetermined threshold, the determination unit determines that the display area is the second area.

11. The image display device according to claim 1, wherein when an average value of gradation values of pixels included in a display area to be determined, of the plurality of display areas, is larger than a predetermined threshold, the determination unit determines that the display area is the first area, and when the average value of the gradation value is not more than the predetermined threshold, the determination unit determines that the display area is the second area.

12. An image display device comprising:

a plurality of light emission units configured to be separately controlled in light emission;

a display panel having a plurality of display areas corresponding to the plurality of light emission units, and configured to transmit light emitted from the plurality of light emission units to display an image based on a display image signal;

a determination unit configured to determine whether the plurality of display areas is a first area satisfying a predetermined condition or a second area having luminance lower than that of the first area, respectively, based on an input image signal;

a light emission control unit configured to control light emitted from the plurality of light emission units to reduce an amount of light emitted from a light emission unit corresponding to the second area relative to an amount of light emitted from a light emission unit corresponding to the first area;

a setting unit configured to determine a luminance setting value based on a result of the determination made by the determination unit;

an estimation unit configured to obtain a luminance estimation value based on the luminance setting value; and a correction unit configured to output the display image signal to the display panel, the display image signal being obtained by adding a first correction value to the portion corresponding to at least partial area of the second area of the input image signal, based on the luminance estimation value, wherein the first correction value to be added by the correction unit is increased as the luminance estimation value is reduced.

13. A control method for an image display device performed by at least one processor, the control method comprising:

determining whether a plurality of display areas of a display panel is a first area satisfying a predetermined condition or a second area having a luminance lower than that of the first area, based on an input image signal;

outputting, to the display panel, a display image signal obtained by adding a first correction value to a portion of the input image signal corresponding to all the second area; and controlling light emitted from the plurality of light emission units to reduce an amount of light emitted from a light emission unit corresponding to the second area of a plurality of light emission units configured to emit light to the display panel, relative to an amount of light emitted from a light emission unit corresponding to the first area of the plurality of light emission units.

14. A control method for an image display device including a plurality of light emission units configured to be separately controlled in light emission, and a display panel having a plurality of display areas corresponding to the plurality of light emission units, and configured to transmit light emitted from the plurality of light emission unit, and display an image, the control method for an image display device comprising:

outputting, to the display panel, a display image signal obtained by adding a first correction value to a portion of an input image signal corresponding to all the second area;

determining whether a plurality of display areas is a first area satisfying a predetermined condition or a second area having a luminance lower than that of the first area, based on the input image signal; and controlling light emitted from the plurality of light emission units to reduce an amount of light emitted from a light emission unit corresponding to the second area, relative to an amount of light emitted from a light emission unit corresponding to the first area.

15. An image display device comprising:

a plurality of light emission units configured to be separately controlled in light emission;

a display panel configured to display an image on a display area by transmitting light emitted from the plurality of light emission units based on a display image signal;

a determination unit configured to determine, based on an input image signal, a first area satisfying a predetermined condition and a second area having luminance lower than that of the first area among the display area;

a generating unit configured to generate the display image signal based on the input image signal, the generating unit increasing gradation values of the input image signal corresponding to the second area, and a light emission control unit configured to control light emitted from the plurality of light emission units such that an amount of light emitted from a light emission unit corresponding to the second area is lower than an amount of light emitted from a light emission unit corresponding to the first area.

16. The image display device according to claim 15, wherein the generating unit does not increase gradation values of the input image signal corresponding to the first area.

17. The image display device according to claim 15, wherein the generating unit generates the display image signal by adding a first correction value to the gradation values of the input image signal corresponding to the second area.

18. The image display device according to claim 17, wherein the generating unit generates the display image signal by adding a second correction value to the gradation values of the input image signal corresponding to the first area, the second correction value is less than the first correction value.

19. The image display device according to claim 17, wherein the generating unit does not add a correction value to the gradation values of the input image signal corresponding to the first area.

20. A control method for an image display device including a plurality of light emission units configured to be separately controlled in light emission and a display panel configured to display an image on a display area by transmitting light emitted from the plurality of light emission units based on a display image signal, the control method for the image display device comprising;

determining, based on an input image signal, a first area satisfying a predetermined condition and a second area having luminance lower than that of the first area among the display area;

generating the display image signal based on the input image signal, the generating unit increasing gradation values of the input image signal corresponding to the second area, and controlling light emitted from the plurality of light emission units such that an amount of light emitted from a light emission unit corresponding to the second area is lower than an amount of light emitted from a light emission unit corresponding to the first area.

* * * * *